US005711467A

United States Patent [19]

Brown, Sr.

[11] Patent Number: 5,711,467

[45] Date of Patent: Jan. 27, 1998

[54] VERTICAL BOW HOLDER DEVICE

[76] Inventor: Ben Seabron Brown, Sr., 236 Angel Farm Dr., Baldwin, Ga. 30511

[21] Appl. No.: 666,208

[22] Filed: Jun. 20, 1996

[51] Int. Cl.[6] ..... F41B 5/00

[52] U.S. Cl. ..... 224/248; 224/250; 224/674; 224/916

[58] Field of Search ..... 224/248, 916, 224/250, 269, 666, 674, 675

[56] References Cited

U.S. PATENT DOCUMENTS

| | | | |
|---|---|---|---|
| 1,048,280 | 12/1912 | Bennett | 224/248 |
| 2,592,688 | 4/1952 | Halfpap et al. | 224/248 |
| 3,157,927 | 11/1964 | Roden | 224/248 X |
| 3,591,062 | 7/1971 | Karbo | 224/916 |
| 4,628,893 | 12/1986 | Shaw, III | 224/269 X |
| 5,450,993 | 9/1995 | Guerrero | 224/250 X |
| 5,611,471 | 3/1997 | French | 224/666 X |

*Primary Examiner*—Renee S. Luebke

[57] ABSTRACT

A vertical bow holder device for offering a new and improved device for carrying a bow on a hunter's belt. The inventive device includes a first continuous bow support rod forming an upper bow support and a second continuous bow support rod forming a lower bow support, with each of the first and second bow support rods having an end portion formed into a belt loop. In use, the hunter hooks the vertical bow holder device onto his belt and then is able to place his bow into the vertical bow holder device and hold the bow there by a retaining string.

7 Claims, 3 Drawing Sheets

VERTICAL BOW HOLDER DEVICE

BACKGROUND OF THE INVENTION

1. Field of the Invention

The present invention relates to bow-supports and more particularly pertains to a new vertical bow holder device for hooking bows onto a hunter's belt.

2. Description of the Prior Art

The use of bow supports is known in the prior art. More specifically, bow-supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art bow supports include U.S. Pat. No. 4,621,752 issued to Youngbauer on 11 Nov. 1986; U.S. Pat. No. 4,121,743 issued to Burton on 24 Oct. 1978; U.S. Pat. No. 4,684,047 issued to Burgwin on 4 Aug. 1987; U.S. Pat. No. 4,103,807 issued to Lyon et al. on 1 Aug. 1978; U.S. Pat. No. Des. 282,271 issued to Morrell on 21 Jan. 1986; U.S. Pat. No. 5,165,584 issued to Meagher et al. on 24 Nov. 1992, and U.S. Pat. No. Des. 354,393 issued to Mocca on 17 Jan. 1995.

While these devices fulfill their respective, particular objectives and requirements, the aforementioned patents do not disclose a new vertical bow holder device The inventive device comprises a first continuous bow support rod forming an upper bow support and a second continuous bow support rod forming a lower bow support, with each of the first and second bow support rods having an end portion formed into a belt loop.

In these respects, the vertical bow holder device according to the present invention substantially departs from the conventional concepts and designs of the prior art, and in so doing provides an apparatus primarily developed for the purpose of offering a new and improved device for carrying a bow in the vertical position on a hunter's belt.

SUMMARY OF THE INVENTION

The general purpose of the present invention, which will be described subsequently in greater detail, is to provide a new vertical bow holder device apparatus and method which has many of the advantages of the bow supports mentioned heretofore and many novel features that result in a new vertical bow holder device which is not anticipated, rendered obvious, suggested, or even implied by any of the prior art bow supports, either alone or in any combination thereof.

To attain this, the present invention comprises a first continuous bow support rod forming an upper bow support and a second continuous bow support rod forming a lower bow support, with each of the first and second bow support rods having an end portion formed into a belt loop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vertical bow holder device apparatus and method which has many of the advantages of the bow supports mentioned heretofore and many novel features that result in a new vertical bow holder device which is not anticipated, rendered obvious, suggested, or even implied by any of the prior art bow supports, either alone or in any combination thereof.

It is another object of the present invention to provide a new vertical bow holder device which may be easily and efficiently manufactured and marketed.

It is a further object of the present invention to provide a new vertical bow holder device which is of a durable and reliable construction.

An even further object of the present invention is to provide a new vertical bow holder device which is susceptible of a low cost of manufacture with regard to both materials and labor, and which accordingly is then susceptible of low prices of sale to the consuming public, thereby making such vertical bow holder device economically available to the buying public.

Still yet another object of the present invention is to provide a new vertical bow holder device which provides in the apparatuses and methods of the prior art some of the advantages thereof, while simultaneously overcoming some of the disadvantages normally associated therewith.

Still another object of the present invention is to provide a new vertical bow holder device for offering a new and improved device for carrying a bow in the vertical position on a hunter's belt.

Yet another object of the present invention is to provide a new vertical bow holder device which includes a first continuous bow support rod forming an upper bow support and a second continuous bow support rod forming a lower bow support, with each of the first and second bow support rods having an end portion formed into a belt loop.

Even still another object of the present invention is to provide a new vertical bow holder device wherein a bow can be carried on the hunter's belt in a vertical position ready for immediate use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
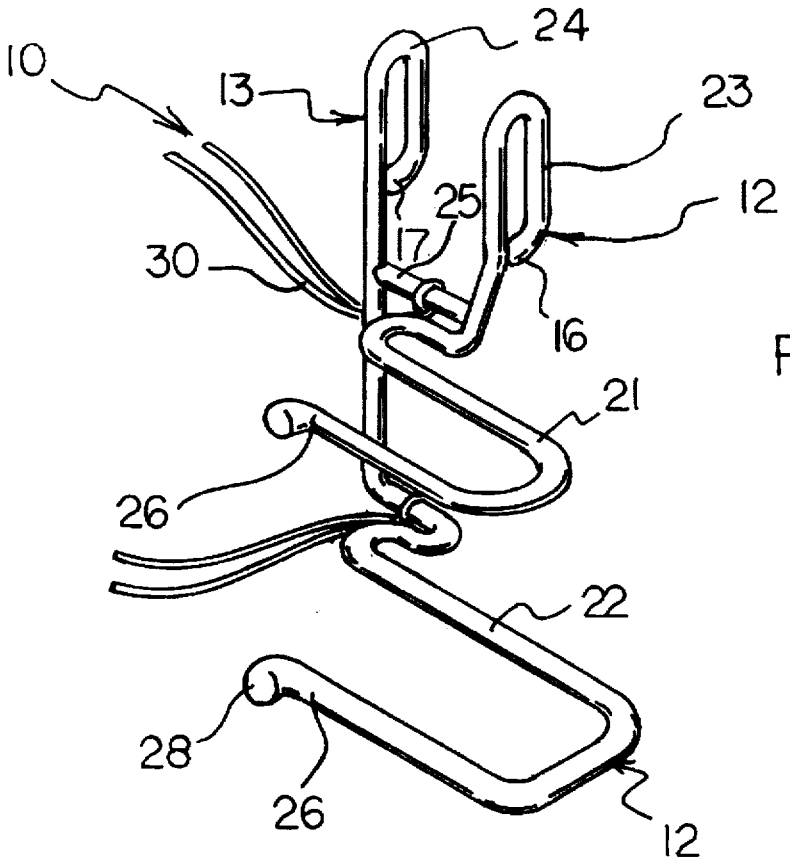
FIG. 1 is a right side perspective view of a new vertical bow holder device according to the present invention.

With reference now to the drawings, and in particular to FIGS. 1 through 6 thereof, a new vertical bow holder device embodying the principles and concepts of the present invention and generally designated by the reference numeral 10 will be described.

More specifically, it will be noted that the vertical bow holder device 10 comprises a continuous formed coated first bow support rod 12 and a second bow support rod 13 (see FIG. 1). The first bow support rod 12 has a first belt attachment portion 23 with a loop end 16, and the second bow support rod 13 has a second belt attachment portion 24 with a loop end 17 (see FIG. 1). The first 23 and second 24 belt attachment portions each form a loop through which a waist belt (or the like) may be threaded to secure the bow holder device to the wearer (see FIGS. 1, 4, and 5). The loop ends 16, 17 of the respective belt attachment portions 23, 24 loop around and touch a more medial portion of the respective support rods 12, 13 (see FIGS. 1 and 4). The loops of the first 23 and second 24 attachment portions are horizontally spaced apart from each other (see FIG. 3). A cross member 25 connects and attaches the first bow support rod 12 to the second bow support rod 13 (see FIGS. 1 and 3).

Figure 2:
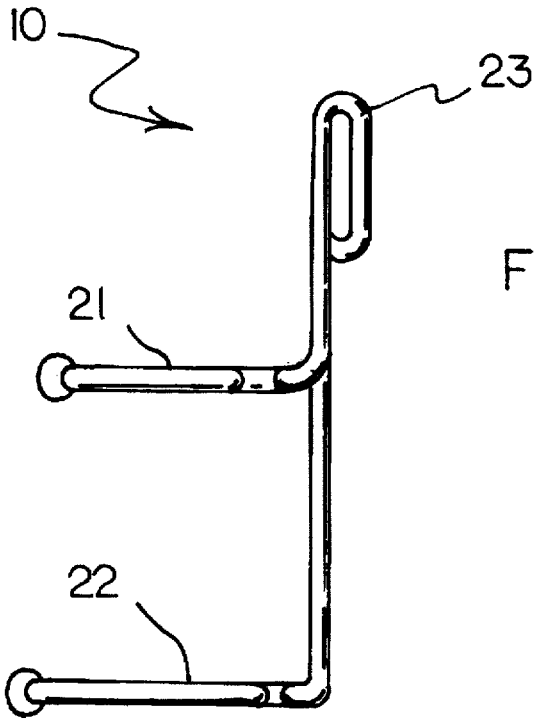
FIG. 2 is a front elevation view thereof.
Figure 3:
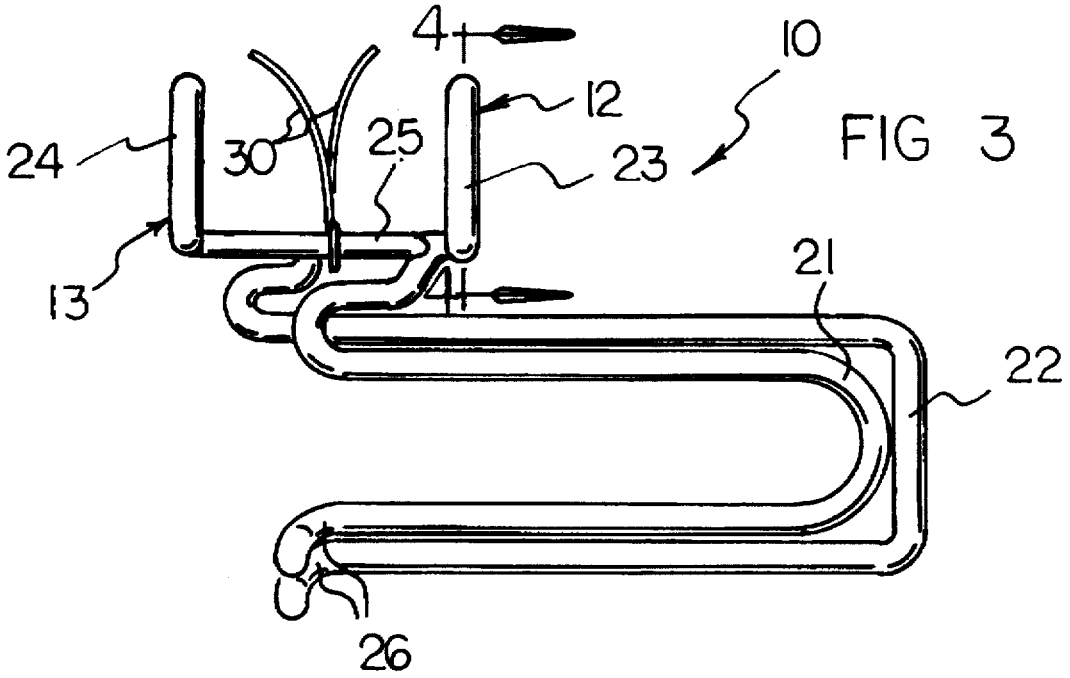
FIG. 3 is a plan of the present invention.
Figure 4:
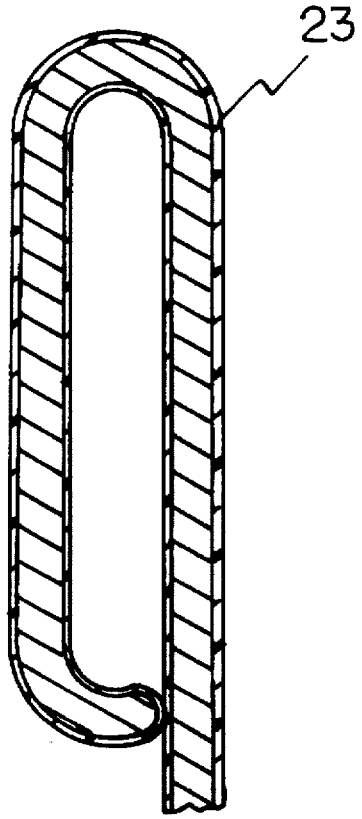
FIG. 4 is a cross section view of one end of a bow support rod of the invention.

The first bow support rod 12 at its end opposite the first belt attachment portion 23 forms an upper bow support 21 (see FIGS. 1 and 3). The second bow support rod 13 at its end opposite the second belt attachment portion 24 forms a lower bow support 22 (see FIGS. 1 and 3). The upper bow support 21 is substantially "U"-shaped to encompass an upper portion of a bow (see FIGS. 1, 3 and 5). The lower bow support 22 is substantially rectangular in shape with one end of the rectangle open for receiving the lower portion of a bow (see FIGS. 1 and 3). The upper 21 and lower 22 bow supports are vertically spaced apart from each other 14 (see FIG. 2). Both the upper bow support 21 and the lower bow support 22 have a string retainer hook 26 which is formed by a bend in the distal free end 28 of each rod (see FIGS. 1, 3 and 6). Secured to each of the first 12 and second 13 bow support rods opposite the distal free end 28 is a retaining string 30 that may be tied to the support rods at the distal ends 28 (see FIGS. 5 and 6). As best illustrated in FIG. 6, the retaining string 30 is used to restrain the bow 14 in the upper 21 and lower 22 bow supports of the vertical bow holder device 10.

Figure 5:
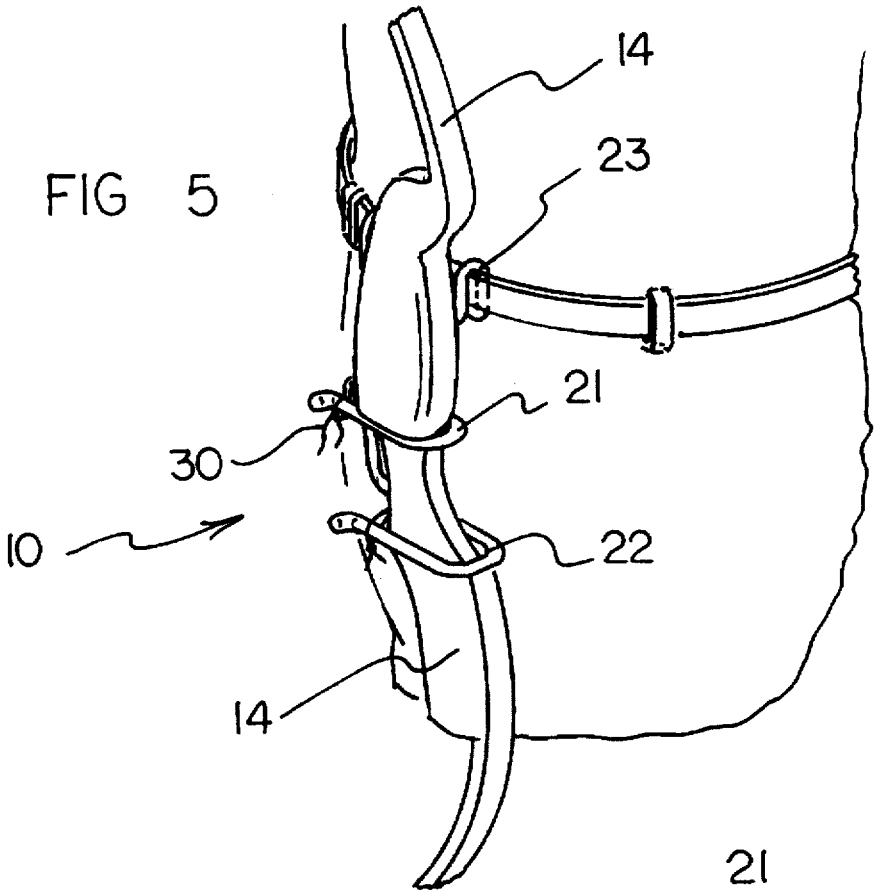
FIG. 5 is a perspective view of the present invention holding a bow in use.
Figure 6:
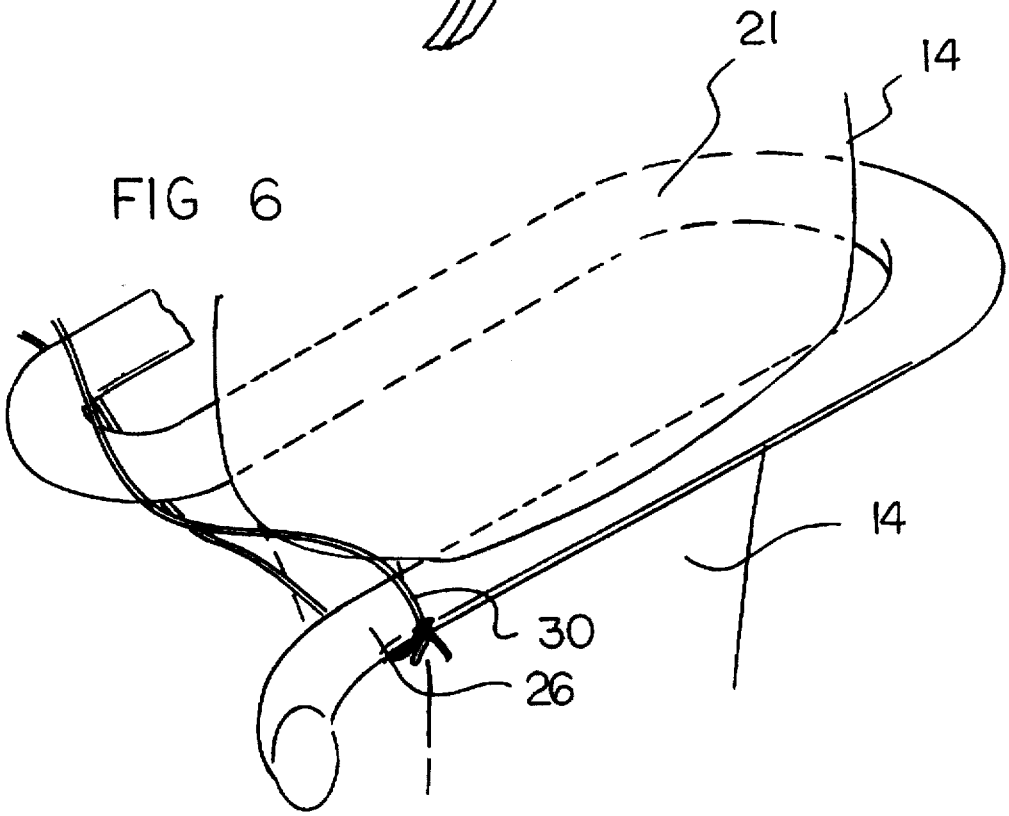
FIG. 6 is an enlarged view of the upper bow support holding a bow.

As best illustrated in FIGS. 1, 2, and 5, it can be shown that the vertical bow holder device 10 is held onto the hunter's belt by a belt loop 23 which is formed in the upper end of the continuous formed coated rod 12 along with a brace and a cross member 25.

In use, the hunter hooks the vertical bow holder device onto his belt and then is able to place his bow into the vertical bow holder device and hold the bow there by a retaining string.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vertical bow holder device for removably mounting a hunting bow on a belt of a wearer, comprising:

a first bow support rod and a second bow support rod, wherein said first bow support rod forms an upper bow support for removably receiving an upper portion of a bow and wherein said second bow support rod forms a lower bow portion for removably receiving a lower portion of a bow, said lower bow support being substantially aligned with said upper bow support such that a bow is supported thereby in a substantially vertical orientation, wherein each said bow support rod has a belt attachment portion, the belt attachment portion of one said bow support rod being spaced from the attachment portion of the other said bow support rod to thereby resist swinging of said bow support rods and a bow held thereby with respect to a belt on which said attachment portions are attached, and each said belt attachment portion forming a loop for substantially completely surrounding a belt passing therethrough to resist dislodgment of said bow support rods from a belt.

2. The vertical bow holder device of claim 1, additionally comprising a string retainer secured to a bow support rod for tying across the bow support of said bow support rod to hold a bow in said bow support.

3. The vertical bow holder device of claim 1 additionally comprising a cross member rod connecting said first and second bow support rods together.

4. The vertical bow holder device of claim 1 wherein the upper bow support of said first bow support rod has a substantially U-shaped configuration.

5. The vertical bow holder device of claim 1 wherein said lower bow support of said second bow support rod has a substantially rectangular configuration with one end of said rectangle open for receiving a bow.

6. The vertical bow holder device of claim 1 wherein said first and second bow support rods comprise at least two separate rods.

7. The vertical bow holder device of claim 1 additionally comprising a string retainer secured to a said bow support rod, and wherein the bow support of said bow support rod has a free end formed by the end of said bow support rod, said free end having a bend adjacent to said free end such that said bend is adapted to hold said string retainer on said free end when said string retainer is tied on said bow support adjacent to said free end.

* * * * *